US011295701B2

(12) United States Patent
Li

(10) Patent No.: US 11,295,701 B2
(45) Date of Patent: Apr. 5, 2022

(54) PIXEL RENDERING METHOD, IMAGE RENDERING METHOD, RENDERING APPARATUS, AND DISPLAY APPARATUS

(71) Applicant: BOE TECHNOLOGY GROUP CO., LTD., Beijing (CN)

(72) Inventor: Zhenzhen Li, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/085,998

(22) Filed: Oct. 30, 2020

(65) Prior Publication Data

US 2021/0049977 A1 Feb. 18, 2021

Related U.S. Application Data

(63) Continuation-in-part of application No. PCT/CN2019/126656, filed on Dec. 19, 2019.

(30) Foreign Application Priority Data

Jan. 16, 2019 (CN) ..... 201910039335.7

(51) Int. Cl.
*G09G 5/02* (2006.01)
*G09G 3/20* (2006.01)

(52) U.S. Cl.
CPC ..... *G09G 5/026* (2013.01); *G09G 3/2003* (2013.01); *G09G 2310/027* (2013.01)

(58) Field of Classification Search
CPC ..... G09G 5/026
See application file for complete search history.

(56) References Cited

U.S. PATENT DOCUMENTS

| | | | | |
|---|---|---|---|---|
| 10,032,403 | B2 | 7/2018 | Matsueda et al. | |
| 2002/0051084 | A1* | 5/2002 | Aneja | H04N 21/42653 348/556 |
| 2008/0225025 | A1 | 9/2008 | Uchino et al. | |
| 2010/0020054 | A1 | 1/2010 | Jepsen | |
| 2010/0302365 | A1 | 12/2010 | Finocchio et al. | |

(Continued)

FOREIGN PATENT DOCUMENTS

| | | | |
|---|---|---|---|
| CN | 101266749 | A | 9/2008 |
| CN | 102448563 | A | 5/2012 |

(Continued)

OTHER PUBLICATIONS

International Search Report and Written Opinion dated Mar. 19, 2020, from International Application No. PCT/CN2019/126656, 17 pages.

(Continued)

*Primary Examiner* — Gustavo Polo
(74) *Attorney, Agent, or Firm* — Procopio, Cory, Hargreaves & Savitch LLP

(57) ABSTRACT

A pixel rendering method includes: receiving first image information corresponding to a first color pixel and m pieces of second image information corresponding to m transparent pixels adjacent to the first color pixel; obtaining, according to the first image information and the m pieces of second image information, image rendering information of the first color pixel; and rendering the first color pixel by using the image rendering information of the first color pixel.

16 Claims, 7 Drawing Sheets

(56) References Cited

U.S. PATENT DOCUMENTS

| | | | | |
|---|---|---|---|---|
| 2011/0181806 | A1 | 7/2011 | Yamazaki | |
| 2013/0106891 | A1* | 5/2013 | Matsueda | G09G 3/2074 345/589 |
| 2016/0035265 | A1 | 2/2016 | Park et al. | |
| 2017/0141163 | A1 | 5/2017 | Xiong et al. | |
| 2018/0252935 | A1 | 9/2018 | Vertegaal et al. | |
| 2020/0111401 | A1 | 4/2020 | Zhao et al. | |
| 2020/0211480 | A1 | 7/2020 | Xiang et al. | |
| 2020/0234634 | A1 | 7/2020 | Li | |
| 2020/0279536 | A1 | 9/2020 | Li et al. | |
| 2021/0049977 | A1 | 2/2021 | Li | |

FOREIGN PATENT DOCUMENTS

| | | | |
|---|---|---|---|
| CN | 102752622 | A | 10/2012 |
| CN | 104157216 | A | 11/2014 |
| CN | 105096806 | A | 11/2015 |
| CN | 107331341 | A | 11/2017 |
| CN | 108009992 | A | 5/2018 |
| CN | 108648679 | A | 10/2018 |
| CN | 108717244 | A | 10/2018 |
| CN | 108766347 | A | 11/2018 |
| CN | 109036245 | A | 12/2018 |
| CN | 109147644 | A | 1/2019 |
| CN | 109559650 | A | 4/2019 |
| EP | 1730697 | B1 | 4/2018 |
| JP | 2013097371 | A | 5/2013 |
| KR | 20110034039 | A | 4/2011 |
| TW | 201604856 | A | 2/2016 |
| WO | 2004038496 | A1 | 5/2004 |
| WO | 2018012927 | A1 | 1/2018 |

OTHER PUBLICATIONS

Zhao et al., "Comparison of Color and Grayscale Simulated TV-Graphics in Rendezvous and Docking" J. Shanghai Jiaotong Univ. (Sci.) (2015) 20(1):68-75.

Xiaoping et al., "Research on Display Panel of New RGBW Mobile Phone" Optoelectronic Technology, vol. 36 No. 4, Dec. 2016.

Notification to Grant Patent Right for Invention dated Oct. 9, 2020, in counterpart CN Patent Application No. 201910039335.7, 10 pages.

Office Action dated Feb. 3, 2020, in counterpart CN Patent Application No. 201910039335.7, 19 pages.

* cited by examiner

PIXEL RENDERING METHOD, IMAGE RENDERING METHOD, RENDERING APPARATUS, AND DISPLAY APPARATUS

CROSS-REFERENCE TO RELATED APPLICATIONS

This application is a Bypass Continuation-in-Part application of PCT/CN2019/126656 filed on Dec. 19, 2019, which claims priority to Chinese Patent Application No. 201910039335.7, filed on Jan. 16, 2019, which are incorporated herein by reference in their entirety.

TECHNICAL FIELD

The present disclosure relates to the field of display technologies, and in particular, to a pixel rendering method, an image rendering method, a rendering apparatus, and a display apparatus.

BACKGROUND

With the development of display technologies, electronic display products such as mobile phones and tablet computers have more and more functions, which have brought a better experience to users. For example, the electronic display products such as mobile phones and tablet computers are equipped with front cameras, which may meet users' needs for taking selfies.

SUMMARY

In an aspect, a pixel rendering method is provided. The pixel rendering method includes: receiving first image information corresponding to a first color pixel and m pieces of second image information corresponding to m transparent pixels adjacent to the first color pixel, and m being an integer greater than or equal to 1; obtaining, according to the first image information and the m pieces of second image information, image rendering information of the first color pixel; and rendering the first color pixel by using the image rendering information of the first color pixel.

In some embodiments, obtaining, according to the first image information and the m pieces of second image information, the image rendering information of the first color pixel, includes: obtaining, according to the first image information, a plurality of pieces of first pixel information of different colors; obtaining, according to the m pieces of second image information, m groups of second pixel information, each group of second pixel information containing a plurality of pieces of second pixel information of different colors; and obtaining, according to grayscale information contained in the plurality of pieces of first pixel information and grayscale information contained in the m groups of second pixel information, grayscale information of a plurality of color sub-pixels in the first color pixel, so that the image rendering information of the first color pixel contains the grayscale information of the plurality of color sub-pixels in the first color pixel.

Grayscale information $p_i^1$ of an i-th color sub-pixel in the first color pixel is:

$$p_i^1 = \text{Gamma}\sqrt{\frac{p_{color(i)}^{1\ Gamma} + p_{trans(1,i)}^{\ Gamma} + \ldots + p_{trans(m,i)}^{\ Gamma}}{m+1}}.$$

$p_{color(i)}^{\ 1}$ is a grayscale value contained in an i-th piece of first pixel information; $p_{trans(1,i)}$ is a grayscale value contained in an i-th piece of second pixel information of a first group; $p_{trans(m,i)}$ is a grayscale value contained in an i-th piece of second pixel information of an m-th group; m is a number of transparent pixels; i is an integer greater than or equal to 1 and less than or equal to 3; and Gamma is a gamma value of a display.

In some embodiments, after obtaining, according to the first image information, the plurality of pieces of first pixel information of different colors, and obtaining, according to the m pieces of second image information, the m groups of second pixel information, obtaining, according to the first image information and the m pieces of second image information, the image rendering information of the first color pixel, further includes: performing color adjustment on color information contained in the plurality of pieces of first pixel information, so as to obtain color correction information of the plurality of color sub-pixels in the first color pixel, so that the image rendering information of the first color pixel contains the color correction information of the plurality of color sub-pixels in the first color pixel.

In another aspect, an image rendering method is provided. The image rendering method is applied to image rendering of a first display area, wherein the first display area includes M first color pixels and S transparent pixels; M and S are both integers greater than or equal to 1, and S is greater than or equal to m. The image rendering method includes: rendering each first color pixel by using the pixel rendering method as described in some embodiments above.

In some embodiments, the image rendering method is further applied to image rendering of a second display area, the second display area includes N second color pixels, each second color pixel includes a common color sub-pixel that is a color sub-pixel shared by two adjacent second color pixels, and N is an integer greater than or equal to 2. The image rendering method further includes: receiving image information of the second display area adjacent to the first display area; obtaining, according to the image information of the second display area, N pieces of third image information corresponding to the N second color pixels; obtaining, according to the N pieces of third image information, image rendering information of the N second color pixels, so that image rendering information of each second color pixel contains grayscale information of a plurality of color sub-pixels in the second color pixel; and rendering the second display area by using the image rendering information of the N second color pixels.

In some embodiments, obtaining, according to the N pieces of third image information, the image rendering information of the N second color pixels, includes: obtaining, according to the N pieces of third image information, N groups of third pixel information corresponding to the N second color pixels, each group of third pixel information containing a plurality of pieces of third pixel information corresponding to the plurality of color sub-pixels in a corresponding second color pixel; and obtaining, according to grayscale information of third pixel information corresponding to a common color sub-pixel in two adjacent second color pixels, grayscale information of the common color sub-pixel in one of the two adjacent second color pixels.

Grayscale information of a common color sub-pixel included in a t-th second color pixel and shared with a (t−1)-th second color pixel is:

$$p^2_{(t,c)} = \text{Gamma}\sqrt{\frac{p^{2\ Gamma}_{color(t,c1)} + p^{2\ Gamma}_{color(t-1,c2)}}{2}}.$$

$p_{color(t,c1)}{}^2$ is a grayscale value contained in third pixel information corresponding to the common color sub-pixel and included in a t-th group of third pixel information; $p_{color(t\text{-}1,c2)}{}^2$ is a grayscale value contained in third pixel information corresponding to the common color sub-pixel and included in a (t−1)-th group of third pixel information; c1 is a sequence number of the common color sub-pixel, shared by the t-th second color pixel and the (t−1)-th second color pixel, in the t-th second color pixel; c2 is a sequence number of the common color sub-pixel, shared by the t-th second color pixel and the (t−1)-th second color pixel, in the (t−1)-th second color pixel; t is an integer greater than or equal to 2 and less than or equal to N; and Gamma is a gamma value of the display.

In some embodiments, in a case where image rendering information of each first color pixel contains grayscale information of a plurality of color sub-pixels in the first color pixel, and image rendering information of each second color pixel contains grayscale information of a plurality of color sub-pixels in the second color pixel, the image rendering method further includes: obtaining, according to grayscale information of color sub-pixels in M first color pixels and grayscale information of color sub-pixels in N second color pixels, grayscale correction information of the color sub-pixels in the M first color pixels; adjusting the grayscale information of the color sub-pixels in the M first color pixels, so that along a direction toward the second display area, grayscale values of color sub-pixels in the first display area gradually approach grayscale values of color sub-pixels in the N second color pixels; and performing brightness uniformization on image rendering information of the M first color pixels and the image rendering information of the N second color pixels.

In yet another aspect, a rendering apparatus is provided. The rendering apparatus includes one or more processors configured to: receive first image information corresponding to a first color pixel and m pieces of second image information corresponding to m transparent pixels adjacent to the first color pixel, m being an integer greater than or equal to 1; obtain, according to the first image information and the m pieces of second image information, image rendering information of the first color pixel; and render the first color pixel by using the image rendering information of the first color pixel.

In some embodiments, the one or more processors are configured to: obtain, according to the first image information, a plurality of pieces of first pixel information of different colors; obtain, according to the m pieces of second image information, m groups of second pixel information, each group of second pixel information containing a plurality of pieces of second pixel information of different colors; and obtain, according to grayscale information contained in the plurality of pieces of first pixel information and grayscale information contained in the m groups of second pixel information, grayscale information of a plurality of color sub-pixels in the first color pixel, so that the image rendering information of the first color pixel contains the grayscale information of the plurality of color sub-pixels in the first color pixel.

grayscale information $p_i{}^1$ of an i-th color sub-pixel in the first color pixel is:

$$p^1_i = \text{Gamma}\sqrt{\frac{p^{1\ Gamma}_{color(i)} + p_{trans(1,i)}{}^{Gamma} + \ldots + p_{trans(m,i)}{}^{Gamma}}{m+1}}.$$

$p_{color(i)}{}^1$ is a grayscale value contained in an i-th piece of first pixel information; $p_{trans(1,i)}$ is a grayscale value contained in an i-th piece of second pixel information of a first group; $p_{trans(m,i)}$ is a grayscale value contained in an i-th piece of second pixel information of an m-th group; m is a number of transparent pixels; i is an integer greater than or equal to 1 and less than or equal to 3; and Gamma is a gamma value of a display.

In some embodiments, the one or more processors are configured to: perform color adjustment on color information contained in the plurality of pieces of first pixel information after obtaining, according to the first image information, the plurality of pieces of first pixel information of different colors, and obtaining, according to the m pieces of second image information, the m groups of second pixel information, so as to obtain color correction information of the plurality of color sub-pixels in the first color pixel, so that the image rendering information of the first color pixel contains the color correction information of the plurality of color sub-pixels in the first color pixel.

In some embodiments, the rendering apparatus further includes one or more memories configured to store the first image information and the m pieces of second image information.

In some embodiments, the rendering apparatus is configured to implement image rendering of a first display area. The first display area includes M first color pixels and S transparent pixels; M and S are both integers greater than or equal to 1, and S is greater than or equal to m. The one or more processors are configured to: render a first color pixel by using the image rendering information of each first color pixel.

In some embodiments, the rendering apparatus is further configured to implement image rendering of a second display area. The second display area includes N second color pixels; each second color pixel includes a common color sub-pixel that is a color sub-pixel shared by two adjacent second color pixels, and N is an integer greater than or equal to 2. The one or more processors are further configured to: receive image information of the second display area adjacent to the first display area; obtain, according to the image information of the second display area, N pieces of third image information corresponding to the N second color pixels; obtain, according to the N pieces of third image information, image rendering information of the N second color pixels, so that image rendering information of each second color pixel contains grayscale information of a plurality of color sub-pixels in the second color pixel; and render the second display area by using the image rendering information of the N second color pixels.

In some embodiments, the one or more processors are further configured to: obtain, according to the N pieces of third image information, N groups of third pixel information corresponding to the N second color pixels, each group of third pixel information containing a plurality of pieces of third pixel information corresponding to the plurality of color sub-pixels in a corresponding second color pixel; and obtain, according to grayscale information of third pixel information corresponding to a common color sub-pixel in two adjacent second color pixels, grayscale information of the common color sub-pixel in one of the two adjacent second color pixels.

Grayscale information of a common color sub-pixel included in a t-th second color pixel and shared with a (t−1)-th second color pixel is:

$$p_{(t,c)}^2 = \text{Gamma}\sqrt{\frac{p_{color(t,c1)}^{2\ Gamma} + p_{color(t-1,c2)}^{2\ Gamma}}{2}}.$$

$p_{color(t,c1)}{}^2$ is a grayscale value contained in third pixel information corresponding to the common color sub-pixel and included in a t-th group of third pixel information; $p_{color(t\text{-}1,c2)}{}^2$ is a grayscale value contained in third pixel information corresponding to the common color sub-pixel and included in a (t−1)-th group of third pixel information; c1 is a sequence number of the common color sub-pixel, shared by the t-th second color pixel and the (t−1)-th second color pixel, in the t-th second color pixel; c2 is a sequence number of the common color sub-pixel, shared by the t-th second color pixel and the (t−1)-th second color pixel, in the (t−1)-th second color pixel; t is an integer greater than or equal to 2 and less than or equal to N; and Gamma is a gamma value of the display.

In some embodiments, in a case where image rendering information of each first color pixel contains grayscale information of a plurality of color sub-pixels in the first color pixel, and image rendering information of each second color pixel contains grayscale information of a plurality of color sub-pixels in the second color pixel, the one or more processors are further configured to: obtain, according to grayscale information of color sub-pixels in M first color pixels and the grayscale information of color sub-pixels in N second color pixel, grayscale correction information of the color sub-pixels in the M first color pixels; adjust the grayscale information of the color sub-pixels in the M first color pixels, so that along a direction toward the second display area, grayscale values of color sub-pixels in the first display area gradually approach grayscale values of color sub-pixels in the N second color pixels; and perform brightness uniformization on image rendering information of the M first color pixels and the image rendering information of the N second color pixels.

In yet another aspect, a display apparatus is provided. The display apparatus includes a display panel and the rendering apparatus as described in some embodiments above. The display panel includes a first color pixel and m transparent pixels adjacent to the first color pixel. The rendering apparatus is electrically connected to the display panel.

In yet another aspect, a non-transitory computer-readable storage medium is provided. The non-transitory computer-readable storage medium stores one or more computer program instructions that, when executed by one or more processors, cause the one or more processors to perform one or more steps in the pixel rendering method as described in some embodiments above.

In yet another aspect, a non-transitory computer-readable storage medium is provided. The non-transitory computer-readable storage medium stores one or more computer program instructions that, when executed by one or more processors, cause the one or more processors to perform one or more steps in the image rendering method as described in some embodiments above.

BRIEF DESCRIPTION OF THE DRAWINGS

In order to describe technical solutions in the present disclosure more clearly, accompanying drawings to be used in some embodiments of the present disclosure will be introduced below briefly. Obviously, the accompanying drawings to be described below are merely accompanying drawings of some embodiments of the present disclosure, and a person of ordinary skill in the art can obtain other drawings according to these drawings. In addition, the accompanying drawings to be described below may be regarded as schematic diagrams, and are not limitations on actual sizes of products, actual processes of methods and actual timings of signals to which the embodiments of the present disclosure relate.

DETAILED DESCRIPTION

Figure 1:
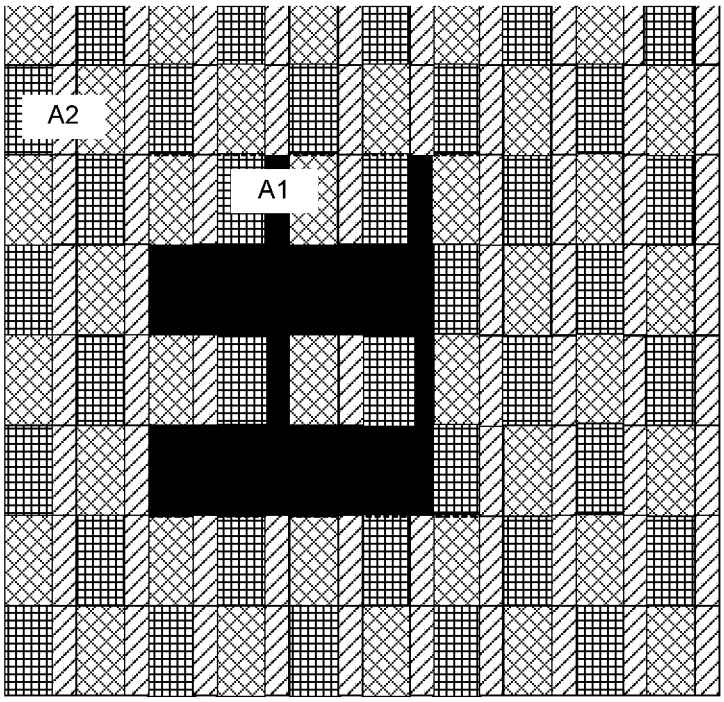
FIG. 1 is a schematic diagram showing an arrangement of pixels in the related art.

Technical solutions in some embodiments of the present disclosure will be described clearly and completely in combination with accompanying drawings. Obviously, the described embodiments are merely some but not all embodiments of the present disclosure. All other embodiments obtained on a basis of the embodiments of the present disclosure by a person of ordinary skill in the art shall be included in the protection scope of the present disclosure.

Unless the context requires otherwise, in the description and the claims, the term "comprise" and other forms thereof such as the third-person singular form "comprises" and the present participle form "comprising" are construed as open and inclusive, i.e., "inclusive, but not limited to". In the description of the specification, terms such as "one embodiment", "some embodiments", "exemplary embodiments", "example", "specific example" or "some examples" are intended to indicate that specific features, structures, materials or characteristics related to the embodiment(s) or example(s) are included in at least one embodiment or example of the present disclosure. Schematic representations of the above terms do not necessarily refer to same embodiment(s) or example(s). In addition, the specific features, structures, materials or characteristics may be included in any one or more embodiments or examples in any suitable manner.

Below, terms such as "first" and "second" are used for descriptive purposes only and are not to be construed as indicating or implying the relative importance or implicitly indicating the number of indicated technical features. Thus, features defined as "first" and "second" may explicitly or implicitly include one or more of the features. In the description of the embodiments of the present disclosure, terms "a plurality of", "the plurality of" and "multiple" each mean two or more unless otherwise specified.

In the description of some embodiments, the terms such as "coupled" and "connected" and their extensions may be used. For example, the term "connected" may be used in the description of some embodiments to indicate that two or more components are in direct physical or electrical contact with each other. For another example, the term "coupled" may be used in the description of some embodiments to indicate that two or more components are in direct physical or electrical contact. The term "coupled" or "communicatively coupled", however, may also mean that two or more elements are not in direct contact with each other, but yet still cooperate or interact with each other. The embodiments disclosed herein are not necessarily limited to the content herein.

The expression "at least one of A, B, and C" has a same meaning as the expression "at least one of A, B, or C", and they both include the following combinations of A, B, and C: only A, only B, only C, a combination of A and B, a combination of A and C, a combination of B and C, and a combination of A, B, and C.

"A and/or B" includes the following three combinations: only A, only B, and a combination of A and B.

At present, a front camera is provided in a display panel included in an electronic display product, and occupies a portion of a display surface of the display panel, which is prone to limit a screen-to-body ratio of the display panel to a certain extent. For this reason, when the display panel is manufactured, a pixel region included in the display panel is divided into a low pixel density region and a normal pixel density region, and the front camera is arranged below the low pixel density region. In this way, when the front camera is used to take photos, outside light may easily pass through the low pixel density region, and be captured by the front camera below the low pixel density region, thereby obtaining a desired image. In addition, it is possible to effectively prevent the front camera from adversely affecting the screen-to-body ratio of the display panel.

For example, the display panel is an organic light-emitting diode (OLED) display panel. As shown in FIG. 1, a plurality of pixels in the OLED display panel are arranged in a PenTile pixel arrangement.

Herein, the PenTile pixel arrangement means: a combination of sub-pixels in a single pixel is a combination of a red sub-pixel and a green sub-pixel, or a combination of a blue sub-pixel and a green sub-pixel; combinations of sub-pixels in two adjacent pixels are different; and in each pixel, in addition to the green sub-pixel, a sub-pixel of the other color may be used both as a sub-pixel of the current pixel and as a sub-pixel of an adjacent pixel. For example, in a same row of pixels, a first pixel includes a red sub-pixel and a green sub-pixel, a second pixel includes a blue sub-pixel and a green sub-pixel, and a third pixel includes a red sub-pixel and a green sub-pixel. The blue sub-pixel included in the second pixel may also be used as a blue sub-pixel of the first pixel, therefore the blue sub-pixel included in the second pixel may be used as a common sub-pixel of the first pixel and the second pixel. The red sub-pixel included in the third pixel may also be used as a red sub-pixel of the second pixel, therefore the red sub-pixel included in the third pixel may be used as a common sub-pixel of the second pixel and the third pixel.

In some embodiments, as shown in FIG. 1, a display area of the OLED display panel includes a first display area A1 and a second display area A2. The first display area A1 is a low pixel density region, the second display area A2 is a normal pixel density region, and a pixel density of the low pixel density region is smaller than a pixel density of the normal pixel density region. Optionally, in the PenTile pixel arrangement shown in FIG. 1, the pixel density of the low pixel density region is one fourth of the pixel density of the normal pixel density region.

When the OLED display panel with the above structure displays an image, image information displayed by two adjacent pixels in the low pixel density region has a large gradient, which may easily result in poor continuity of images displayed on the low pixel density region.

Some embodiments of the present disclosure provide a pixel rendering method, an image rendering method, a rendering apparatus, and a display apparatus to improve the problem of poor continuity of images displayed on the low pixel density region. The pixel rendering method and the image rendering method may be performed by one or more processors of the display apparatus.

It will be noted that, for the first display area A1 as a low pixel density region, pixels included in the first display area A1 may be divided into a plurality of low-density pixel units. Each low-density pixel unit includes a first color pixel and at least one transparent pixel adjacent to the first color pixel, so as to form continuous pixel points. The number of the transparent pixels may be set according to actual needs. For example, a transparent pixel is defined as a pixel point including at least one transparent sub-pixel.

Figure 4:
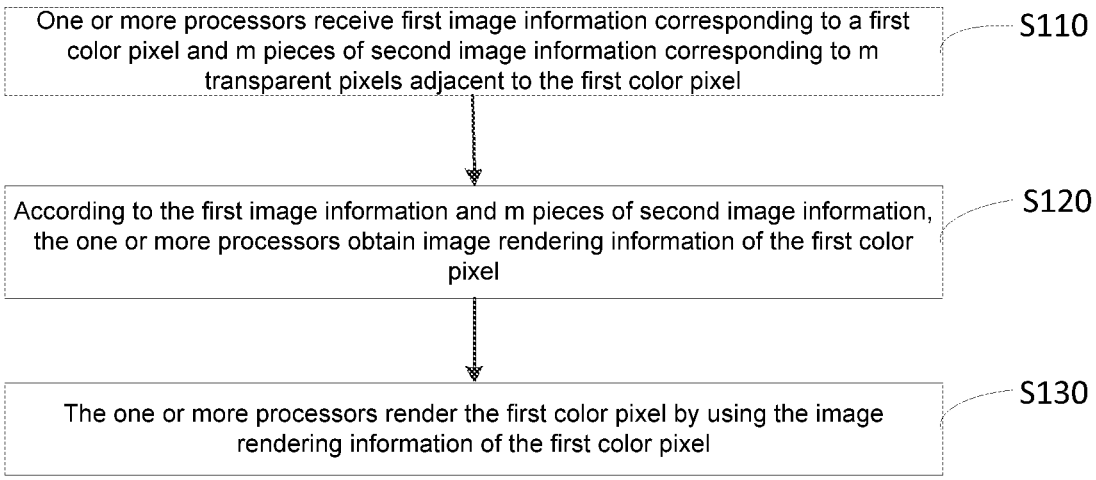
FIG. 4 is a flow diagram of a pixel rendering method, in accordance with some embodiments of the present disclosure.

Some embodiments of the present disclosure provide a pixel rendering method. As shown in FIG. 4, the pixel rendering method includes S110 to S130.

In S110, one or more processors receive first image information corresponding to a first color pixel and m pieces of second image information corresponding to m transparent pixels adjacent to the first color pixel, wherein m is an integer greater than or equal to 1.

The first image information and the m pieces of second image information may be received or retrieved by the one or more processors from a memory or a system mainboard of the display apparatus connected to data source.

In the related art, the first image information can be displayed by the first color pixel, whereas the second image information cannot be displayed by the transparent pixel.

In S120, according to the first image information and m pieces of second image information, the one or more processors obtain image rendering information of the first color pixel.

This enables the image rendering information of the first color pixel to not only render the first image information into the first color pixel, but also render the second image information into the first color pixel.

In S130, the one or more processors render the first color pixel by using the image rendering information of the first color pixel.

As can be seen from the above pixel rendering method, the image rendering information of the first color pixel may be obtained according to the first image information and the m pieces of second image information. The first image information corresponds to the first color pixel, the second image information corresponds to the transparent pixel, and the first color pixel is adjacent to the m transparent pixels. Therefore, an image displayed by the first color pixel that is rendered by using the image rendering information of the first color pixel not only contains content of the first image information, but also contains content of the second image information. In this way, in a case where the pixel rendering method provided by some embodiments of the present disclosure is applied to rendering of color pixels in a low pixel density region, it is ensured that the color pixels in the low pixel density region may display more image information, thereby improving a continuity of an image displayed on the low pixel density region without changing an arrangement of pixels of the low pixel density region.

Figure 5:
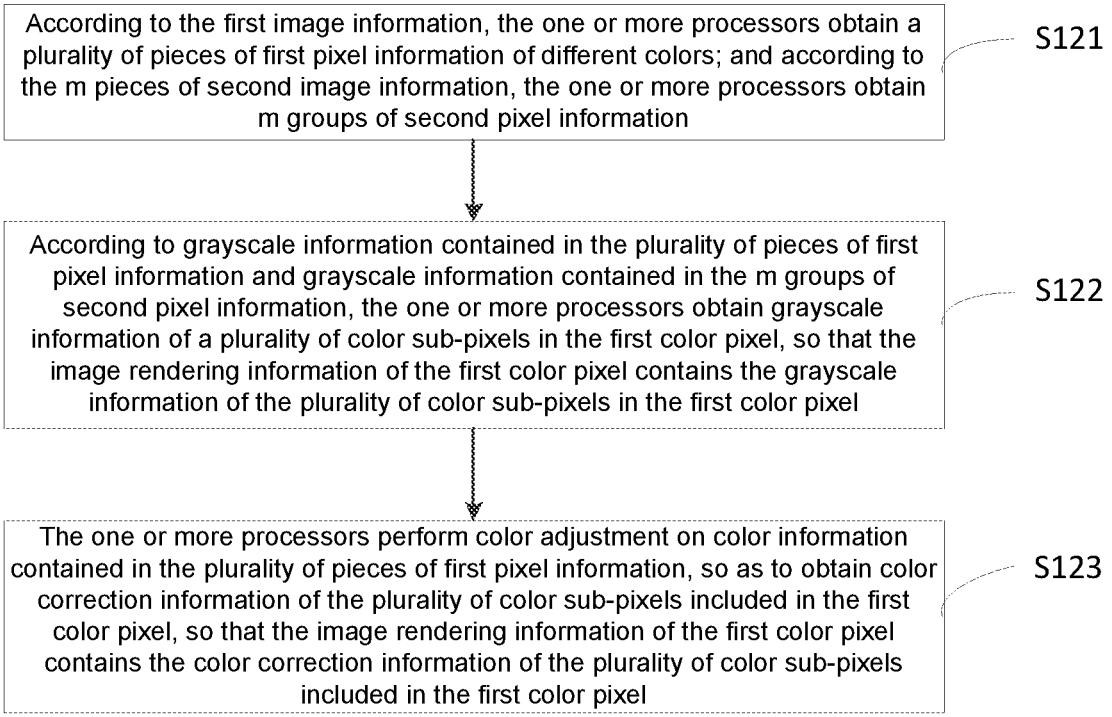
FIG. 5 is a flow diagram of another pixel rendering method, in accordance with some embodiments of the present disclosure.

It can be understood that, the first image information and the second image information both contain grayscale information and color information. In this case, as shown in FIG. 5, obtaining, according to the first image information and the m pieces of second image information, the image rendering information of the first color pixel, includes S121 to S123.

In S121, according to the first image information, the one or more processors obtain a plurality of pieces of first pixel information of different colors; and according to the m pieces of second image information, the one or more processors obtain m groups of second pixel information, and each group of second pixel information contains a plurality of pieces of second pixel information of different colors.

Each piece of first pixel information represents pixel data information of a color sub-pixel in the first color pixel, and the pixel data information thereof contains grayscale information and color information. Each group of second pixel information represents pixel data information of a plurality of transparent sub-pixels in a corresponding transparent pixel, and the pixel data information thereof contains grayscale information and color information.

In S122, according to grayscale information contained in the plurality of pieces of first pixel information and grayscale information contained in them groups of second pixel information, the one or more processors obtain grayscale information of a plurality of color sub-pixels in the first color pixel, so that the image rendering information of the first color pixel contains the grayscale information of the plurality of color sub-pixels in the first color pixel.

Grayscale information $p_i^1$ of an i-th color sub-pixel in the first color pixel is:

$$p_i^1 = \text{Gamma}\sqrt[\text{Gamma}]{\frac{p_{color(i)}^{1\,\text{Gamma}} + p_{trans(1,i)}^{\text{Gamma}} + \ldots + p_{trans(m,i)}^{\text{Gamma}}}{m+1}}.$$

Where $p_{color(i)}^1$ is a grayscale value contained in an i-th piece of first pixel information; $p_{trans(1,i)}$ is a grayscale value contained in an i-th piece of second pixel information of a first group; $p_{trans\,(m,i)}$ is a grayscale value contained in an i-th piece of second pixel information of an m-th group; m is a number of transparent pixels; i is an integer greater than or equal to 1 and less than or equal to 3; and Gamma is a gamma value of a display with a range of 2.0 to 2.5 and with a general value of 2.2.

It will be noted that, after obtaining the image rendering information of the first color pixel, i.e., the grayscale information of the plurality of color sub-pixels in the first color pixel, one or more processors may send the grayscale information of the plurality of color sub-pixels in the first color pixel to a data driver circuit, so that the data driver circuit can convert the grayscale information into corresponding data voltages, and then apply them to corresponding first color pixel in the display apparatus, so as to realize the rendering of the first color pixel.

A method for obtaining the grayscale information of color sub-pixels in the first color pixel is described below by taking a low-density pixel unit shown in FIG. 2 as an example.

Figure 2:
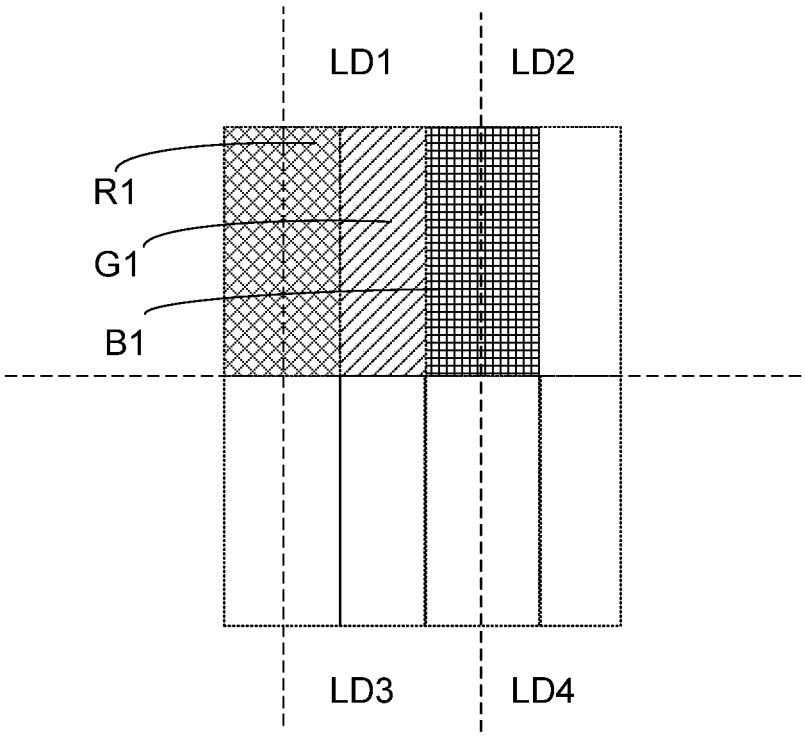
FIG. 2 is a schematic diagram showing a distribution of pixels with a low pixel density, in accordance with some embodiments of the present disclosure.

As shown in FIG. 2, the low-density pixel unit includes four low-density pixels. The four low-density pixels include a first low-density pixel LD1, a second low-density pixel LD2, a third low-density pixel LD3, and a fourth low-density pixel LD4. The first low-density pixel LD1 is defined as a first color pixel, the second low-density pixel LD2 is defined as a first transparent pixel, the third low-density pixel LD3 is defined as a second transparent pixel, and the fourth low-density pixel LD4 is defined as a third transparent pixel. The first color pixel includes a first red sub-pixel R1, a first green sub-pixel G1, and a first blue sub-pixel B1.

The first image information includes first red pixel information corresponding to the first red sub-pixel R1, first green pixel information corresponding to the first green sub-pixel G1, and first blue pixel information corresponding to the first blue sub-pixel B1. The number of groups of the second pixel information is three: a first group of second pixel information, a second group of second pixel information, and a third group of second pixel information. Each group of second pixel information includes second red pixel information, second green pixel information, and second blue pixel information.

In the related art, when the low-density pixel unit shown in FIG. 2 displays an image, a portion corresponding to a first row of low-density pixels and a second row of low-density pixels of the image displayed by the low-density pixel unit will have a certain missing. A portion corresponding to a first column of low-density pixels of the image displayed by the low-density pixel unit will have a certain missing, and a portion corresponding to a second column of low-density pixels of the image displayed by the low-density pixel unit will be completely missing. These results in unsmooth transition of the image displayed by the low-density pixel unit and a problem of discontinuity of the image.

Based on this, the pixel rendering method provided by the embodiments of the present disclosure may reset grayscale information of the first red sub-pixel R1, the first blue sub-pixel B1, and the first green sub-pixel G1 that are included in the first color pixel, so that the image rendering information of the first color pixel contains the grayscale information of the first red sub-pixel R1, the first blue sub-pixel B1, and the first green sub-pixel G1 that are included in the first color pixel. Therefore, the first color pixel contains both the first image information and the second image information after being rendered.

An expression of the grayscale information $p_R^1$ (grayscale value) of the first red sub-pixel R1 is:

$$p_R^1 = \sqrt[\text{Gamma}]{\frac{p_{color(R)}^{1\,\text{Gamma}} + p_{trans(1,R)}^{\text{Gamma}} + p_{trans(2,R)}^{\text{Gamma}} + p_{trans(3,R)}^{\text{Gamma}}}{4}}.$$

Where $p_{color(R)}^1$ is a grayscale value contained in the first red pixel information; $p_{trans(1,R)}$ is a grayscale value contained in second red pixel information included in the first group of second pixel information; $p_{trans(2,R)}$ is a grayscale value contained in second red pixel information included in the second group of second pixel information; and $p_{trans(3,R)}$ is a grayscale value contained in second red pixel information included in the third group of second pixel information.

An expression of the grayscale information $p_G^1$ (grayscale value) of the first green sub-pixel G1 is:

$$p_G^1 = \sqrt[Gamma]{\frac{p_{color(G)}^{1\,Gamma} + p_{trans(1,G)}^{Gamma} + p_{trans(2,G)}^{Gamma} + p_{trans(3,G)}^{Gamma}}{4}}.$$

Where $p_{color(G)}^1$ is a grayscale value contained in the first green pixel information; $p_{trans(1,G)}$ is a grayscale value contained in second green pixel information included in the first group of second pixel information; $p_{trans(2,G)}$ is a grayscale value contained in second green pixel information included in the second group of second pixel information; and $p_{trans(3,G)}$ is a grayscale value contained in second green pixel information included in the third group of second pixel information.

An expression of the grayscale information $p_B^1$ (grayscale value) of the first blue sub-pixel B1 is:

$$p_B^1 = \sqrt[Gamma]{\frac{p_{color(B)}^{1\,Gamma} + p_{trans(1,B)}^{Gamma} + p_{trans(2,B)}^{Gamma} + p_{trans(3,B)}^{Gamma}}{4}}.$$

Where $p_{color(B)}$ is a grayscale value contained in the first blue pixel information; $p_{trans(1,B)}$ is a grayscale value contained in second blue pixel information included in the first group of second pixel information; $p_{trans(2,B)}$ is a grayscale value contained in second blue pixel information included in the second group of second pixel information; and $p_{trans(3,B)}$ is a grayscale value contained in second blue pixel information included in the third group of second pixel information.

It can be understood that, the first blue sub-pixel B1 in the first color pixel may be a blue sub-pixel independent used by the first color pixel, or may be a blue sub-pixel shared with another pixel.

In a case where the first color pixel contains a sub-pixel shared by the first color pixel and another low-density pixel, the image displayed by the low-density pixel unit will have a certain color shift. Based on this, as shown in FIG. 5, after obtaining, according to the first image information, the plurality of pieces of first pixel information of different colors, and obtaining, according to the m pieces of second pixel information, the m groups of second image information, obtaining, according to the first image information and the m pieces of second image information, the image rendering information of the first color pixel, further includes S123.

In S123, the one or more processors perform color adjustment on color information contained in the plurality of pieces of first pixel information, so as to obtain color correction information of the plurality of color sub-pixels included in the first color pixel, so that the image rendering information of the first color pixel contains the color correction information of the plurality of color sub-pixels included in the first color pixel.

In this case, the first color pixel is rendered by using the image rendering information of the first color pixel, so that the problem of color shift of the image displayed by the first color pixel may be improved.

There are various ways for performing the color adjustment, which may be selected according to actual needs. Herein, S123 and S122 may be performed simultaneously or in order.

Figure 6:
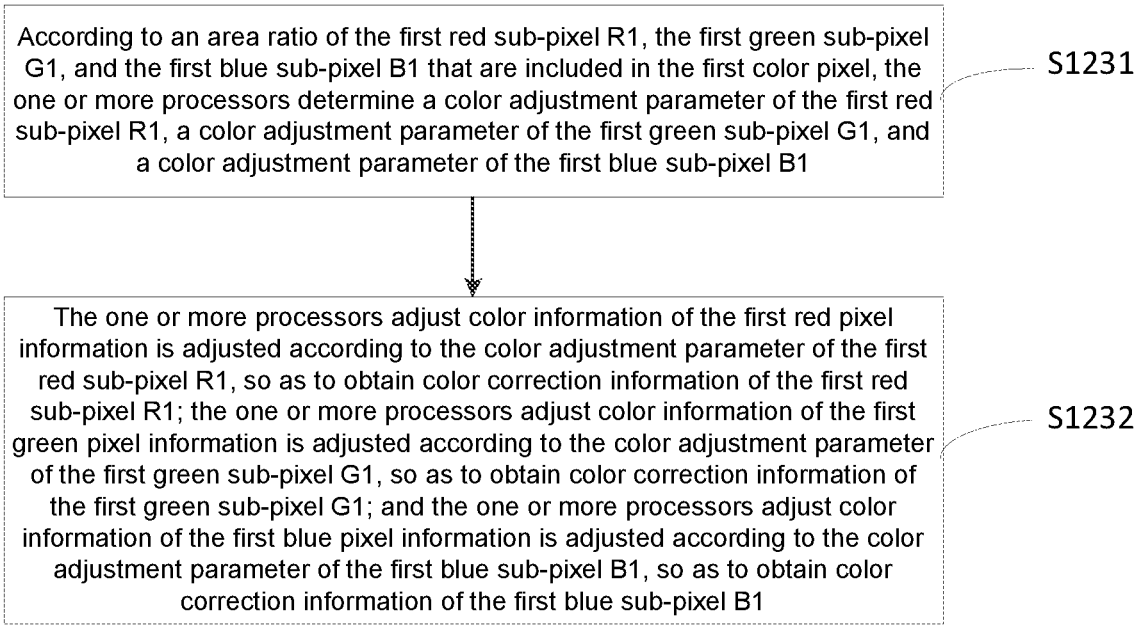
FIG. 6 is a flow diagram of yet another pixel rendering method, in accordance with some embodiments of the present disclosure.

For example, as shown in FIG. 6, performing color adjustment on color information contained in the plurality of pieces of first pixel information includes S1231 to S1232.

In S1231, according to an area ratio of the first red sub-pixel R1, the first green sub-pixel G1, and the first blue sub-pixel B1 that are included in the first color pixel, the one or more processors determine a color adjustment parameter of the first red sub-pixel R1, a color adjustment parameter of the first green sub-pixel G1, and a color adjustment parameter of the first blue sub-pixel B1.

Since the area ratio of the first red sub-pixel R1, the first green sub-pixel G1, and the first blue sub-pixel B1 is determined, color adjustment parameters of respective sub-pixels may be changed according to the relationship of the areas of first red sub-pixel R1, the first green sub-pixel G1, and the first blue sub-pixel B1, so that the colors of the respective sub-pixels are harmonious.

In S1232, the one or more processors adjust color information of the first red pixel information according to the color adjustment parameter of the first red sub-pixel R1, so as to obtain color correction information of the first red sub-pixel R1, the one or more processors adjust color information of the first green pixel information according to the color adjustment parameter of the first green sub-pixel G1, so as to obtain color correction information of the first green sub-pixel G1, and the one or more processors adjust color information of the first blue pixel information according to the color adjustment parameter of the first blue sub-pixel B1, so as to obtain color correction information of the first blue sub-pixel B1.

As shown in FIGS. 1 and 4, the embodiments of the present disclosure further provide an image rendering method, which is applied to image rendering of the first display area A1. The first display area A1 includes M first color pixels and S transparent pixels. M and S are both integers greater than or equal to 1, and S is greater than or equal to m. The image rendering method includes: rendering each first color pixel by using the pixel rendering method described above.

Compared with the related art, the image rendering method provided by the embodiments of the present disclosure has the same beneficial effects as the pixel rendering method described above, and details will not be repeated herein.

It can be understood that, since each first color pixel has a different position, and the first color pixel is adjacent to the transparent pixels in the above pixel rendering method, positions of respective transparent pixels involved when the first color pixels are rendered by using the pixel rendering method described above may be different.

Figure 8:
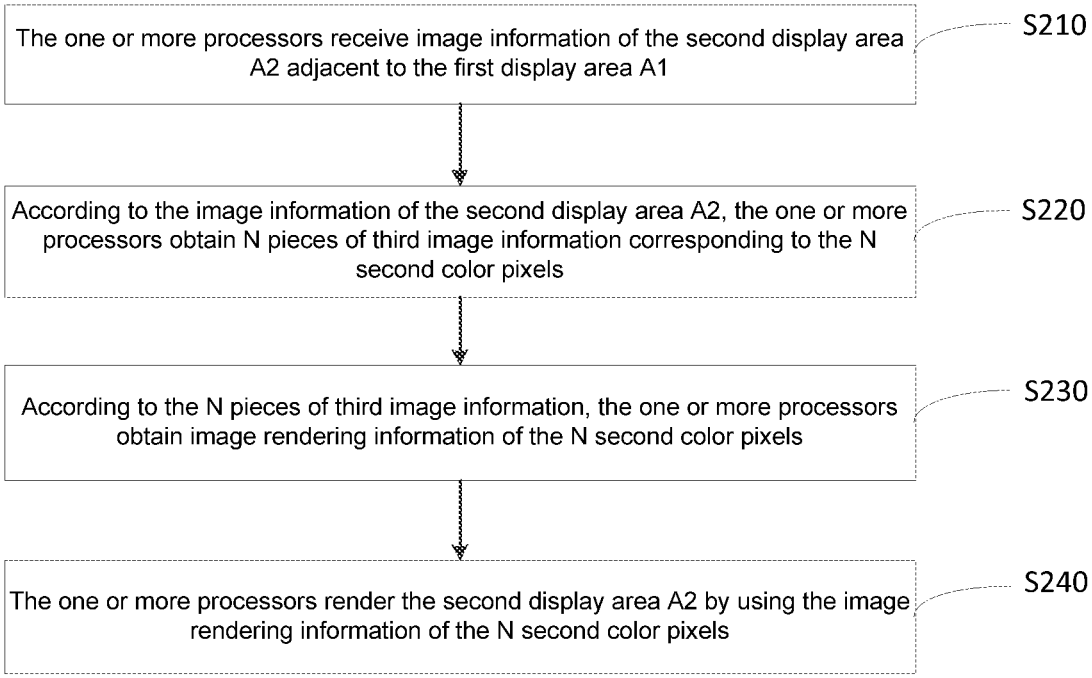
FIG. 8 is a flow diagram of an image rendering method, in accordance with some embodiments of the present disclosure.

In some embodiments, as shown in FIG. 1, the image rendering method is further applied to image rendering of the second display area A2. The second display area A2 is a normal pixel density region, and includes N second color pixels. Each second color pixel has a common color sub-pixel that is a color sub-pixel shared by two adjacent second color pixels. In this case, color sub-pixels of the second display area A2 are not enough to display pixel information contained in image information of the second display area A2. Based on this, as shown in FIGS. 1 and 8, the image rendering method further includes S210 to S240.

In S210, the one or more processors receive image information of the second display area A2 adjacent to the first display area A1.

The image information of the second display area A2 may be received or retrieved by the one or more processors from the memory or the system mainboard of the display apparatus connected to data source.

In S220, according to the image information of the second display area A2, the one or more processors obtain N pieces of third image information corresponding to the N second color pixels.

Since the second display area A2 includes N second color pixels, the image information of the second display area A2 also includes N pieces of third image information corresponding to the N second color pixels.

In S230, according to the N pieces of third image information, the one or more processors obtain image rendering information of the N second color pixels. Image rendering information of each second color pixel contains grayscale information of a plurality of color sub-pixels in the second color pixel.

In S240, the one or more processors render the second display area A2 by using the image rendering information of the N second color pixels.

It will be noted that, after obtaining the image rendering information of the N second color pixels, the one or more processors may send the image rendering information of the N second color pixels to the data driver circuit, so that the data driver circuit can convert the grayscale information into corresponding data voltages, and then apply them to corresponding second colors pixels in the display apparatus, so as to realize the rendering of the second color pixels.

Figure 3:
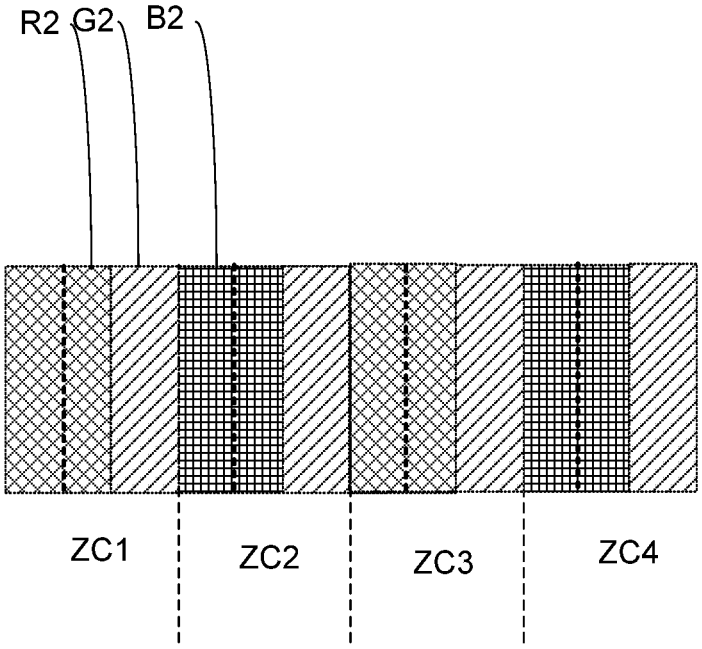
FIG. 3 is a schematic diagram showing a distribution of pixels with a normal pixel density, in accordance with some embodiments of the present disclosure.
Figure 9:
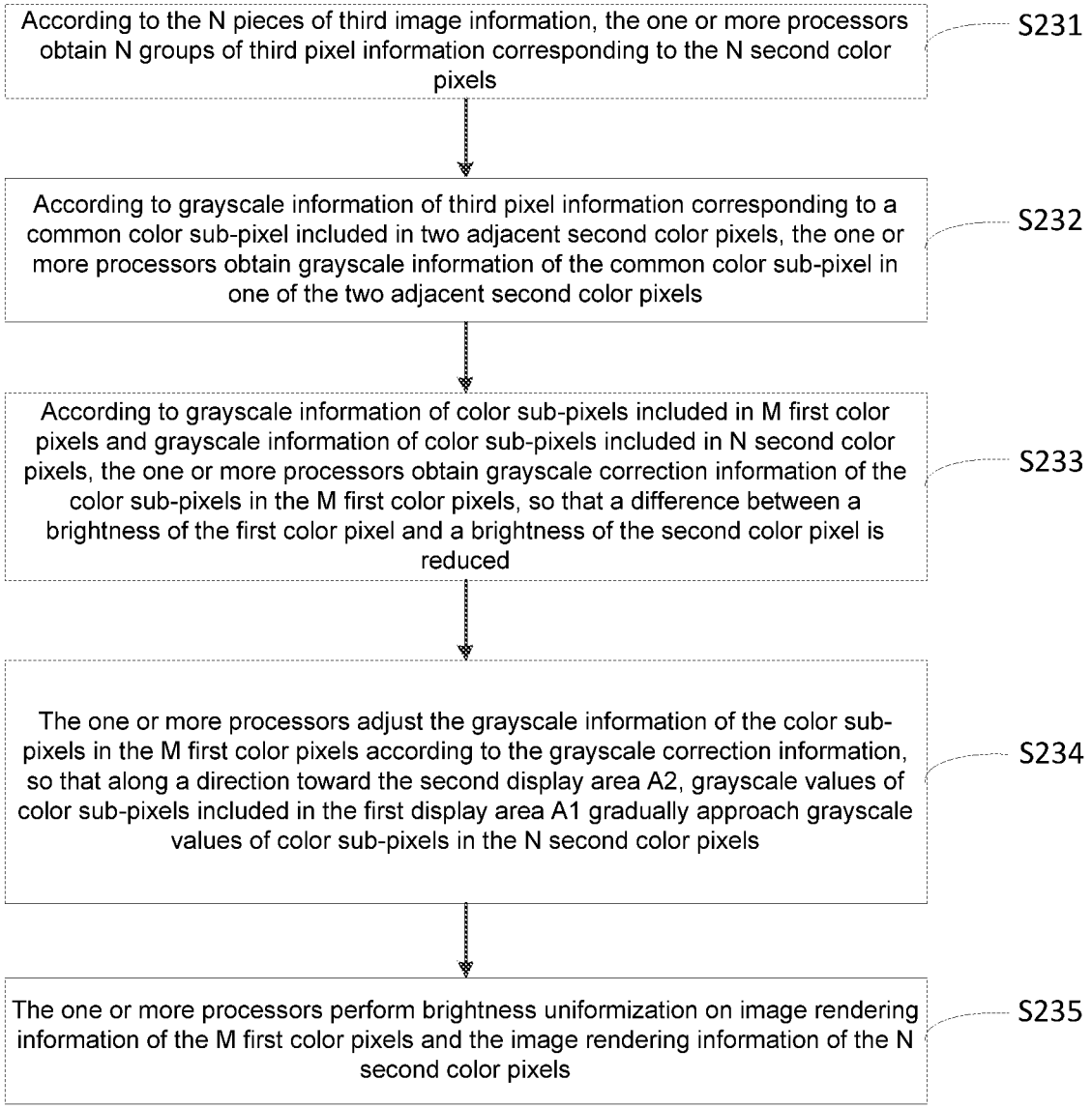
FIG. 9 is a flow diagram of another image rendering method, in accordance with some embodiments of the present disclosure.

The third image information contains grayscale information and color information. For example, as shown in FIGS. 3 and 9, obtaining, according to the N pieces of third image information, the image rendering information of the N second color pixels, includes S231 to S235.

In S231, according to the N pieces of third image information, the one or more processors obtain N groups of third pixel information corresponding to the N second color pixels. Each group of third pixel information contains a plurality of pieces of third pixel information corresponding to the plurality of color sub-pixels included in a corresponding second color pixel.

In S232, according to grayscale information of third pixel information corresponding to a common color sub-pixel included in two adjacent second color pixels, the one or more processors obtain grayscale information of the common color sub-pixel in one of the two adjacent second color pixels.

Grayscale information $p_{(t,c)}^2$ of a common color sub-pixel included in a t-th second color pixel and shared with a (t−1)-th second color pixel is:

$$p_{(t,c)}^2 = \text{Gamma}\sqrt{\frac{p_{color(t,c1)}^{2\ Gamma} + p_{color(t-1,c2)}^{2\ Gamma}}{2}}.$$

Where $p_{color(t,c1)}^2$ is a grayscale value contained in third pixel information corresponding to the common color sub-pixel and included in a t-th group of third pixel information; $p_{color(t-1,c2)}^2$ is a grayscale value contained in third pixel information corresponding to the common color sub-pixel and included in a (t−1)-th group of third pixel information; c1 is a sequence number of the common color sub-pixel, shared by the t-th second color pixel and the (t−1)-th second color pixel, in the t-th second color pixel; c2 is a sequence number of the common color sub-pixel, shared by the (t)-th second color pixel and the (t−1)-th second color pixel, in the (t−1)-th second color pixel; t is an integer greater than or equal to 2 and less than or equal to N; and Gamma is the gamma value of the display with a range of 2.0 to 2.5 and with a general value of 2.2.

FIG. 3 is a schematic diagram showing a pixel arrangement of a normal density pixel unit included in the second display area A2. It is arranged that a normal density pixel unit includes four normal density pixels, and the four normal density pixels include a first normal density pixel ZC1, a second normal density pixel ZC2, a third normal density pixel ZC3, and a fourth normal density pixel ZC4. Each normal density pixel includes a second red sub-pixel R2 and a second green sub-pixel G2, or a second blue sub-pixel B2 and a second green sub-pixel G2. Two adjacent normal density pixels have a common sub-pixel. For example, a second blue sub-pixel in the second normal density pixel ZC2 is shared with the first normal density pixel ZC1, so that the first normal density pixel ZC1 may emit white light. The number of groups of the third image information is four. Each group of third image information includes third red pixel information corresponding to a second red pixel in a corresponding normal density pixel, third green pixel information corresponding to a second green pixel in the corresponding normal density pixel, and third blue pixel information corresponding to a second blue pixel in the corresponding normal density pixel.

As can be seen from FIG. 3, in the normal density pixels, the second red sub-pixel R2 and the second blue sub-pixel B2 are common color sub-pixels, and the second green sub-pixel G2 is not a common color sub-pixel. Based on this, grayscale information $p_{(2,B)}^2$ (grayscale value) of the second blue sub-pixel B2 in the second normal density pixel ZC2 is:

$$p_{(2,B)}^2 = \text{Gamma}\sqrt{\frac{p_{color(2,B)}^{2\ Gamma} + p_{color(1,B)}^{2\ Gamma}}{2}}.$$

Where $p_{color(1,B)}^2$ is a grayscale value contained in second blue pixel information included in a first group of third pixel information, and $p_{color(2,B)}^2$ is a grayscale value contained in second blue pixel information included in a second group of third pixel information.

Grayscale information $p_{(2,G)}^2$ (grayscale value) of the second green sub-pixel G2 in the second normal density pixel ZC2 is: $p_{(2,G)}^2 = p_{color(2,G)}^2$. $p_{color(2,G)}^2$ is a grayscale value contained in second green pixel information in the second group of third pixel information.

Since the second red sub-pixel R2 in the third normal density pixel ZC3 can be shared with the second normal density pixel ZC2, there is no second red sub-pixel R2 in the second normal density pixel ZC2, but the second group of third pixel information contains second red pixel information. In this case, grayscale information $p_{(2,R)}^2$ (grayscale value) of the second red sub-pixel R2 in the second normal density pixel ZC2 is:

$$p_{(3,R)}^2 = p_{(2,R)}^2 = \text{Gamma}\sqrt{\frac{p_{color(3,R)}^{2\ Gamma} + p_{color(2,R)}^{2\ Gamma}}{2}}.$$

Where $p_{color(2,R)}^{2}$ is a grayscale value contained in the second red pixel information included in the second group of third pixel information, and $p_{color(3,R)}^{2}$ is the second red pixel information included in a third group of third pixel information.

In some embodiments, as shown in FIG. 9, in a case where image rendering information of each first color pixel contains grayscale information of a plurality of color sub-pixels in the first color pixel, and image rendering information of each second color pixel contains grayscale information of the color sub-pixels in the second color pixel, the image rendering method further includes S233 to S235.

In S233, according to grayscale information of color sub-pixels included in M first color pixels and grayscale information of color sub-pixels included in N second color pixels, the one or more processors obtain grayscale correction information of the color sub-pixels in the M first color pixels, so that a difference between a brightness of the first color pixel and a brightness of the second color pixel is reduced, thereby improving a brightness of the first display area and improving a uniformity of visual effects of the first display area A1 and the second display area A2.

For example, grayscale correction information of an i-th color sub-pixel included in an r-th first color pixel is $p_{(r,i)}^{1J}=\gamma p_{(r,i)}^{1}$. γ is a grayscale correction parameter, and γ is a constant greater than 1. Here, γ may be determined according to the display brightness of the second color pixel, as long as the difference between the brightness of the first color pixel and the brightness of the second color pixel may be reduced.

In S234, the one or more processors adjust the grayscale information of the color sub-pixels in the M first color pixels according to the grayscale correction information, so that along a direction toward the second display area A2, grayscale values of color sub-pixels included in the first display area A1 gradually approach grayscale values of color sub-pixels in the N second color pixels.

For example, the grayscale values included in the grayscale correction information of the color sub-pixels determined in the S233 are used to replace the original grayscale values, so as to realize the adjustment of the grayscale information of the color sub-pixels.

Since the grayscale values of color sub-pixels included in the first display area A1 gradually approach the grayscale values of color sub-pixels in the plurality of second color pixels, a boundary between the first display area A1 and the second display area A2 may be blurred, and the uniformity of visual effects of the first display area A1 and the second display area A2 may be further improved.

In S235, the one or more processors perform brightness uniformization on image rendering information of the M first color pixels and the image rendering information of the N second color pixels.

This may alleviate the problem of uneven brightness (mura) caused by various problems during the display process. In addition, the brightness uniformization method may be referred to the prior art, and details will not be described.

As can be seen from the above, when the image rendering method described above is used to render the normal pixel density region and the low pixel density region, grayscale information contained in the normal pixel density region and the low pixel density region is processed first. Then, a brightness of the low pixel density region is enhanced, and an image boundary between the normal pixel density region and the low pixel density region may be blurred, so that the uniformity of visual effects of images displayed in the normal pixel density region and the low pixel density region is improved. Next, color information of the low pixel density region is corrected, so as to alleviate the problem of color shift in the image displayed in the low pixel density region. Afterwards, pixel grayscales of the normal pixel density region and the low pixel density region are further adjusted, so as to alleviate the problem of poor brightness uniformity (mura) of the image caused by various problems.

Figure 7:
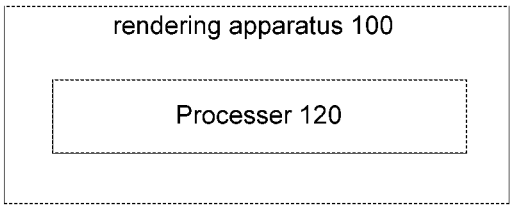
FIG. 7 is a schematic diagram of a rendering apparatus, in accordance with some embodiments of the present disclosure.

Some embodiments of the present disclosure further provide a rendering apparatus, and as shown in FIG. 7, the rendering apparatus 100 includes one or more processors 120. The one or more processors 120 are configured to: receive first image information corresponding to a first color pixel and m pieces of second image information corresponding to m transparent pixels adjacent to the first color pixel, and m is an integer greater than or equal to 1; obtain, according to the first image information and the m pieces of second image information, image rendering information of the first color pixel; and render the first color pixel by using the image rendering information of the first color pixel.

Figure 10:
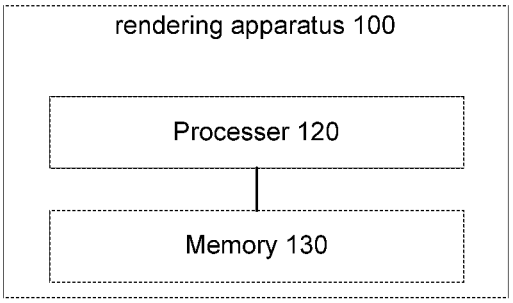
FIG. 10 is a schematic diagram of another rendering apparatus, in accordance with some embodiments of the present disclosure.

In some embodiments, as shown in FIG. 10, the rendering apparatus 100 further includes one or more memories 130 connected to the one or more processors 120 and configured to store the first image information and the m pieces of second image information.

As for a specific implementation process of the rendering apparatus provided by the embodiments of the present disclosure, reference may be made to the foregoing description of the pixel rendering method, and details will not be repeated herein.

Compared with the related art, the rendering apparatus provided by the embodiments of the present disclosure has the same beneficial effects as the pixel rendering method described above, and details will not be repeated herein.

In some embodiments, as shown in FIGS. 5 and 7, the one or more processors 120 are configured to obtain, according to the first image information, a plurality of pieces of first pixel information of different colors; obtain, according to the m pieces of second image information, m groups of second pixel information, each group of second pixel information containing a plurality of pieces of second pixel information of different colors; and obtain, according to grayscale information contained in the plurality of pieces of first pixel information and grayscale information contained in the m groups of second pixel information, grayscale information of a plurality of color sub-pixels in the first color pixel, so that the image rendering information of the first color pixel contains the grayscale information of the plurality of color sub-pixels in the first color pixel.

Grayscale information $p_i^1$ of an i-th color sub-pixel included in the first color pixel is:

$$p_i^1 = \text{Gamma}\sqrt{\frac{p_{color(i)}^{1\ Gamma} + p_{trans(1,i)}^{\ Gamma} + \ldots + p_{trans(m,i)}^{\ Gamma}}{m+1}}.$$

Where $p_{color(i)}^{1}$ is a grayscale value contained in an i-th piece of first pixel information; $p_{trans(1,i)}$ is a grayscale value contained in an i-th piece of second pixel information of a first group; $p_{trans(m,i)}$ is a grayscale value contained in an i-th piece of second pixel information of an m-th group; m is a number of transparent pixels, i is an integer greater than or equal to 1 and less than or equal to 3; and Gamma is a gamma value of a display.

In some embodiments, as shown in FIG. 7, the one or more processors 120 are configured to perform color adjustment on color information contained in the plurality of pieces of first pixel information, after obtaining, according to the first image information, the plurality of pieces of first pixel information of different colors, and obtaining, according to the m pieces of second image information, the m groups of second pixel information, so as to obtain color correction information of the plurality of color sub-pixels in the first color pixel, so that the image rendering information of the first color pixel contains the color correction information of the plurality of color sub-pixels in the first color pixel.

In some embodiments, as shown in FIG. 7, the one or more processors 120 are further configured to determine, according to an area ratio of the first red sub-pixel R1, the first green sub-pixel G1, and the first blue sub-pixel B1 that are included in the first color pixel, a color adjustment parameter of the first red sub-pixel R1, a color adjustment parameter of the first green sub-pixel G1, and a color adjustment parameter of the first blue sub-pixel B1, adjust color information of the first red pixel information according to the color adjustment parameter of the first red sub-pixel R1, so as to obtain color correction information of the first red sub-pixel R1, adjust color information of the first green pixel information according to the color adjustment parameter of the first green sub-pixel G1, so as to obtain color correction information of the first green sub-pixel G1 and adjust color information of the first blue pixel information according to the color adjustment parameter of the first blue sub-pixel B1, so as to obtain color correction information of the first blue sub-pixel B1.

In some embodiments, the rendering apparatus 100 is configured to implement image rendering of the first display area A1. The first display area A1 includes M first color pixels and S transparent pixels, M and S are both integers greater than or equal to 1, and S is greater than or equal to m. In this case, the one or more processors 120 are configured to render the first color pixel by using the image rendering information of each first color pixel.

As shown in FIGS. 1, 4 and 7, in some embodiments, the rendering apparatus 100 is further configured to implement image rendering of the second display area A2. The second display area A2 includes N second color pixels, and each second color pixel includes a common color sub-pixel that is a color sub-pixel shared by two adjacent second color pixels, wherein N is an integer greater than or equal to 2.

As shown in FIGS. 1, 7 and 8, the one or more processors 120 are further configured to receive image information of the second display area A2 adjacent to the first display area A1 obtain, according to the image information of the second display area A2, N pieces of third image information corresponding to the N second color pixels; obtain, according to the N pieces of third image information, image rendering information of the N second color pixels, so that image rendering information of each second color pixel contains grayscale information of a plurality of color sub-pixels in the second color pixel; and render the second display areas A2 by using the image rendering information of the N second color pixels.

In some embodiments, the one or more memories 130 are further configured to store image information of the second display area A2.

In some embodiments, as shown in FIGS. 3, 7 and 9, the one or more processors 120 are further configured to obtain, according to the N pieces of third pixel information, N groups of third pixel information corresponding to the N second color pixels, each group of third pixel information containing a plurality of pieces of third pixel information corresponding to the plurality of color sub-pixels in a corresponding second color pixel; and obtain, according to grayscale information of third pixel information corresponding to a common color sub-pixel included in two adjacent second color pixels, grayscale information of the common color sub-pixel in one of the two adjacent second color pixels.

Grayscale information $p_{(t,c)}{}^2$ of a common color sub-pixel included in a t-th second color pixel and shared with a (t−1)-th second color pixel is:

$$p^2_{(t,c)} = \text{Gamma}\sqrt{\frac{p^{2\ Gamma}_{color(t,c1)} + p^{2\ Gamma}_{color(t-1,c2)}}{2}}.$$

$p_{color(t,c1)}{}^2$ is a grayscale value contained in third pixel information corresponding to the common color sub-pixel and included in the t-th group of third pixel information; $p_{color(t-1,c2)}{}^2$ is a grayscale value contained in third pixel information corresponding to the common color sub-pixel and included in the (t−1)-th group of third pixel information; c1 is a sequence number of the common color sub-pixel, shared by the t-th second color pixel and the (t−1)-th second color pixel, in the t-th second color pixel; c2 is a sequence number of the common color sub-pixel, shared by the t-th second color pixel and the (t−1)-th second color pixel, in the (t−1)-th second color pixel; t is an integer greater than or equal to 2 and less than or equal to N; and Gamma is the gamma value of the displayer.

In some embodiments, as shown in FIGS. 1, 7 and 9, in a case where image rendering information of each first color pixel contains the grayscale information of a plurality of color sub-pixels in the first color pixel, and image rendering information of each second color pixel contains the grayscale information of a plurality of color sub-pixels in the second color pixel, the one or more processors 120 are further configured to obtain, according to grayscale information of color sub-pixels in M first color pixels and grayscale information of color sub-pixels in N second color pixels, grayscale correction information of the color sub-pixels in the M first color pixels, so that a difference between a brightness of the first color pixel and a brightness of the second color pixel is reduced; adjust the grayscale information of the color sub-pixels in the M first color pixels, so that along a direction toward the second display area A2, grayscale values of the color sub-pixels in the first display area A1 gradually approach grayscale values of the color sub-pixels in the N second color pixels; and perform brightness uniformization on image rendering information of the M first color pixels and the image rendering information of the N second color pixels.

In some examples, the above processor 120 may be a central processing unit (CPU) or an application specific integrated circuit (ASIC), or one or more integrated circuits configured to implement the embodiments of the present disclosure, such as one or more digital signal processors (DSPs), or one or more field programmable gate arrays (FPGAs). For example, the processor 120 has information transceiving function and algorithm functions, and different functions may be implemented by different parts of the circuit inside the processor 120.

The above memory 130 is configured to store executable program codes and the like. The memory 130 may be a random access memory (RAM), or a non-volatile memory, such as a disk memory, or a flash memory (Flash).

Some embodiments of the present disclosure further provide a display apparatus. The display apparatus includes a display panel and the rendering apparatus electrically connected to the display panel.

Compared with the related art, the display apparatus provided by the embodiments of the present disclosure has the same beneficial effects as the rendering apparatus described above, and details will not be repeated herein.

Figure 11:
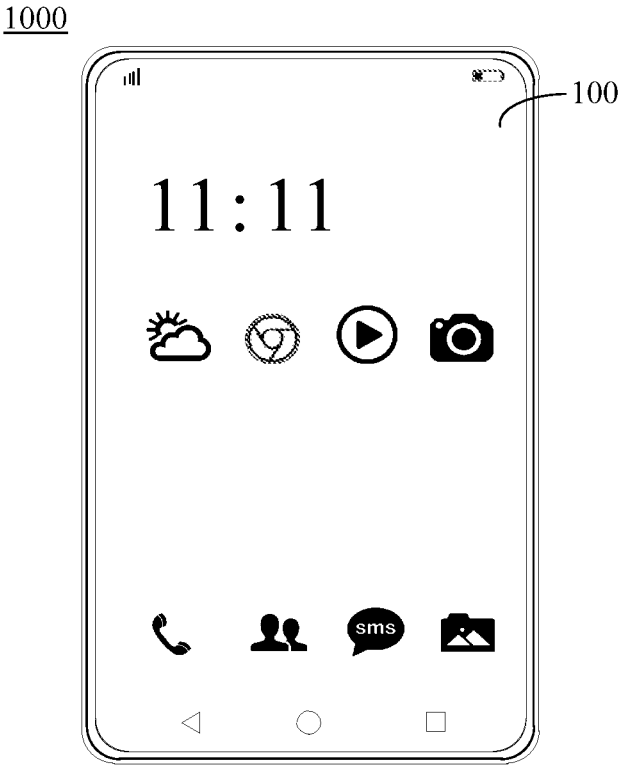
FIG. 11 is a schematic diagram of a display apparatus, in accordance with some embodiments of the present disclosure.

For example, as shown in FIG. 11, the display apparatus 1000 provided by the embodiments may be any product or component having a display function, such as a mobile phone, a tablet computer, a television, a displayer, a notebook computer, a digital photo frame, or a navigator.

Some embodiments of the present disclosure provide a non-transitory computer-readable storage medium storing one or more computer program instructions. When executed by one or more processors, the computer program instructions cause the one or more processors to perform one or more steps of at least one of the pixel rendering method and the image rendering method that are described in some embodiments above.

Compared with the related art, the non-transitory computer-readable storage medium provided by the embodiments of the present disclosure has the same beneficial effects as the pixel rendering method and/or the image rendering method described above, and details will not be repeated herein.

The non-transitory computer-readable storage medium may be a storage device, or may be a collective name of a plurality of storage elements, and is used to store executable program codes. Moreover, the non-transitory computer-readable storage medium may include a random access memory (RAM), and may also include a non-volatile memory, such as a disk memory or a flash memory (Flash).

Figure 12:
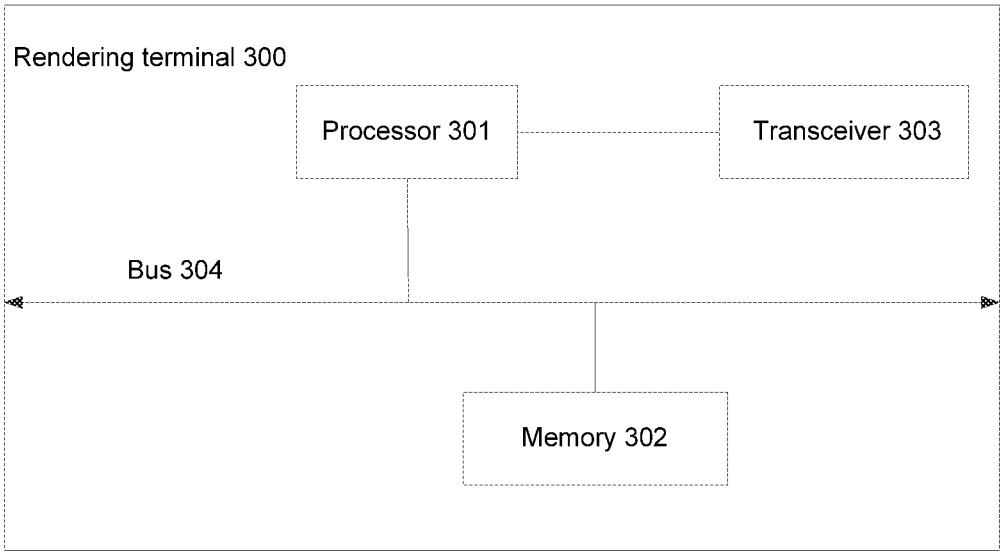
FIG. 12 is a schematic diagram of a rendering terminal, in accordance with some embodiments of the present disclosure.

As shown in FIG. 12, some embodiments of the present disclosure provide a rendering terminal 300. The rendering terminal 300 includes a transceiver 303, a processor 301, a memory 302, and a bus 304. The transceiver 303, the processor 301, and the memory 302 communicate with each other through the bus 304. The rendering terminal 300 may be integrated with a display control device, or may be provided independently from the display control device.

The memory 302 is used to store computer program instructions to implement the pixel rendering method and/or the image rendering method provided by the embodiments of the present disclosure, and the processor 301 executes the instructions to implement the pixel rendering method and/or the image rendering method.

The processor 301 described in the embodiments of the present disclosure may be a processor, or may be a collective name of a plurality of processing elements. For example, the processor 301 may be a central processing unit (CPU) or an application specific integrated circuit (ASIC), or one or more integrated circuits used to implement the embodiments of the present disclosure, such as one or more digital signal processors (DSPs), or one or more field programmable gate arrays (FPGAs).

The memory 302 may be a storage device, or may be a collective name of a plurality of storage elements, and is used to store executable program codes. Moreover, the memory 302 may include a random access memory (RAM), and may also include a non-volatile memory, such as a disk memory, and a flash memory (Flash).

The bus 304 may be an Industry Standard Architecture (ISA) bus, a Peripheral Component Interconnect (PCI) bus, or an Extended Industry Standard Architecture (EISA) bus. The bus 304 may include an address bus, a data bus, a control bus, etc. For ease of description, the bus 304 is only represent by a thick line in FIG. 10, but it does not mean that there is only one bus or only one type of bus.

The embodiments in the present description are described in a progressive manner. As for the same or similar parts among the embodiments, reference may be made to each other. Description of each embodiment focuses on differences between the embodiment and other embodiments. In particular, as for embodiments of apparatuses, since they are substantially similar to embodiments of methods, descriptions thereof are relatively simple. For relevant information, reference may be made to parts of description of the embodiments of methods.

A person of ordinary skill in the art will understand that: all or part of the process in the embodiments of methods described above may be implemented by using computer program instructions to control related hardware to perform the process. The computer program instructions may be stored in a computer-readable storage medium. The program may include the process of the embodiments of the above methods when executed. The storage medium may be a magnetic disk, an optical disk, a read-only storage memory (ROM), a random storage memory (RAM), etc.

Embodiments of the present disclosure further provide a computer program product. The computer program product includes computer program instructions. When executed by a computer, the computer program instructions cause the computer to perform one or more steps in the pixel rendering method and/or the image rendering method described in some of the embodiments above.

Embodiments of the present disclosure further provide a computer program. When executed by a computer, the computer program causes the computer to perform one or more steps in the pixel rendering method and/or the image rendering method described in some of the embodiments above.

The forgoing descriptions are merely specific implementation manners of the present disclosure, but the protection scope of the present disclosure is not limited thereto. Any person skilled in the art could conceive of changes or replacements within the technical scope of the present disclosure, which shall all be included in the protection scope of the present disclosure. Therefore, the protection scope of the present disclosure shall be subject to the protection scope of the claims.

What is claimed is:

1. A pixel rendering method, comprising:

receiving first image information corresponding to a first color pixel and m pieces of second image information corresponding to m transparent pixels adjacent to the first color pixel, and m being an integer greater than or equal to 1;

obtaining, according to the first image information and the m pieces of second image information, image rendering information of the first color pixel; and rendering the first color pixel by using the image rendering information of the first color pixel, wherein obtaining, according to the first image information and the m pieces of second image information, the image rendering information of the first color pixel, includes:

obtaining, according to the first image information, a plurality of pieces of first pixel information of different colors;

obtaining, according to the m pieces of second image information, m groups of second pixel information, each group of second pixel information containing a plurality of pieces of second pixel information of different colors; and obtaining, according to grayscale information contained in the plurality of pieces of first pixel information and grayscale information contained in the m groups of second pixel information, grayscale information of a plurality of color sub-pixels in the first color pixel, so that the image rendering information of the first color pixel contains the grayscale information of the plurality of color sub-pixels in the first color pixel, wherein grayscale information $p_i^1$ of an i-th color sub-pixel in the first color pixel is:

$$p_i^1 = \text{Gamma}\sqrt{\frac{p_{color(i)}^{1\,Gamma} + p_{trans(1,i)}^{Gamma} + \ldots + p_{trans(m,i)}^{Gamma}}{m+1}},$$

wherein $p_{color(i)}{}^1$ is a grayscale value contained in an i-th piece of first pixel information; $p_{trans(1,i)}$ is a grayscale value contained in an i-th piece of second pixel information of a first group; $p_{trans(m,i)}$ is a grayscale value contained in an i-th piece of second pixel information of an m-th group; m is a number of transparent pixels; i is an integer greater than or equal to 1 and less than or equal to 3; and Gamma is a gamma value of a display.

2. The pixel rendering method according to claim 1, wherein after obtaining, according to the first image information, the plurality of pieces of first pixel information of different colors, and obtaining, according to the m pieces of second image information, the m groups of second pixel information, obtaining, according to the first image information and the m pieces of second image information, the image rendering information of the first color pixel, further includes:

performing color adjustment on color information contained in the plurality of pieces of first pixel information, so as to obtain color correction information of the plurality of color sub-pixels in the first color pixel, so that the image rendering information of the first color pixel contains the color correction information of the plurality of color sub-pixels in the first color pixel.

3. An image rendering method, applied to image rendering of a first display area, wherein the first display area includes M first color pixels and S transparent pixels; M and S are both integers greater than or equal to 1, and S is greater than or equal to m; and the image rendering method comprises:

rendering each first color pixel by using the pixel rendering method according to claim 1.

4. The image rendering method according to claim 3, wherein the image rendering method further applied to image rendering of a second display area, the second display area includes N second color pixels, each second color pixel includes a common color sub-pixel that is a color sub-pixel shared by two adjacent second color pixels, and N is an integer greater than or equal to 2; and the image rendering method further comprises:

receiving image information of the second display area adjacent to the first display area;

obtaining, according to the image information of the second display area, N pieces of third image information corresponding to the N second color pixels;

obtaining, according to the N pieces of third image information, image rendering information of the N second color pixels, so that image rendering information of each second color pixel contains grayscale information of a plurality of color sub-pixels in the second color pixel; and rendering the second display area by using the image rendering information of the N second color pixels.

5. The image rendering method according to claim 4, wherein obtaining, according to the N pieces of third image information, the image rendering information of the N second color pixels, includes:

obtaining, according to the N pieces of third image information, N groups of third pixel information corresponding to the N second color pixels, each group of third pixel information containing a plurality of pieces of third pixel information corresponding to the plurality of color sub-pixels in a corresponding second color pixel; and obtaining, according to grayscale information of third pixel information corresponding to a common color sub-pixel in two adjacent second color pixels, grayscale information of the common color sub-pixel in one of the two adjacent second color pixels, wherein grayscale information of a common color sub-pixel included in a t-th second color pixel and shared with a (t−1)-th second color pixel is:

$$p_{(t,c)}^2 = \text{Gamma}\sqrt{\frac{p_{color(t,c1)}^{2\,Gamma} + p_{color(t-1,c2)}^{2\,Gamma}}{2}},$$

wherein $p_{color(t,c1)}{}^2$ is a grayscale value contained in third pixel information corresponding to the common color sub-pixel and included in a t-th group of third pixel information; $p_{color(t-1,c2)}{}^2$ is a grayscale value contained in third pixel information corresponding to the common color sub-pixel and included in a (t−1)-th group of third pixel information; c1 is a sequence number of the common color sub-pixel, shared by the t-th second color pixel and the (t−1)-th second color pixel, in the t-th second color pixel; c2 is a sequence number of the common color sub-pixel, shared by the t-th second color pixel and the (t−1)-th second color pixel, in the (t−1)-th second color pixel; t is an integer greater than or equal to 2 and less than or equal to N; and Gamma is a gamma value of the display.

6. The image rendering method according to claim 4, wherein in a case where image rendering information of each first color pixel contains grayscale information of a plurality of color sub-pixels in the first color pixel, and image rendering information of each second color pixel contains grayscale information of a plurality of color sub-pixels in the second color pixel, the image rendering method further comprises:

obtaining, according to grayscale information of color sub-pixels in M first color pixels and grayscale information of color sub-pixels in N second color pixels, grayscale correction information of the color sub-pixels in the M first color pixels;

adjusting the grayscale information of the color sub-pixels in the M first color pixels, so that along a direction toward the second display area, grayscale values of color sub-pixels in the first display area gradually approach grayscale values of color sub-pixels in the N second color pixels; and performing brightness uniformization on image rendering information of the M first color pixels and the image rendering information of the N second color pixels.

7. A rendering apparatus, comprising one or more processors configured to:

receive first image information corresponding to a first color pixel and m pieces of second image information corresponding to m transparent pixels adjacent to the first color pixel, m being an integer greater than or equal to 1;

obtain, according to the first image information and the m pieces of second image information, image rendering information of the first color pixel; and render the first color pixel by using the image rendering information of the first color pixel;

the one or more processors are further configured to:

obtain, according to the first image information, a plurality of pieces of first pixel information of different colors;

obtain, according to the m pieces of second image information, m groups of second pixel information, each group of second pixel information containing a plurality of pieces of second pixel information of different colors; and obtain, according to grayscale information contained in the plurality of pieces of first pixel information and grayscale information contained in the in groups of second pixel information, grayscale information of a plurality of color sub-pixels in the first color pixel, so that the image rendering information of the first color pixel contains the grayscale information of the plurality of color sub pixels in the first color pixel, wherein grayscale information $p_i^1$ of an i-th color sub-pixel in the first color pixel is:

$$p_i^1 = \text{Gamma}\sqrt{\frac{p_{color(i)}^{1\ Gamma} + p_{trans(1,i)}^{\ Gamma} + \ldots + p_{trans(m,i)}^{\ Gamma}}{m+1}},$$

wherein $p_{color(i)}^{\ 1}$ is a grayscale value contained in an i-th piece of first pixel information; $p_{trans(1,t)}$ is a grayscale value contained in an i-th piece of second pixel information of a first group; $p_{trans(m,i)}$ is a grayscale value contained in an i-th piece of second pixel information of an m-th group; m is a number of transparent pixels; i is an integer greater than or equal to 1 and less than or equal to 3; and Gamma is a gamma value of a display.

8. The rendering apparatus according to claim 7, wherein the one or more processors are configured to:

perform color adjustment on color information contained in the plurality of pieces of first pixel information after obtaining, according to the first image information, the plurality of pieces of first pixel information of different colors, and obtaining, according to the m pieces of second image information, the m groups of second pixel information, so as to obtain color correction information of the plurality of color sub-pixels in the first color pixel, so that the image rendering information of the first color pixel contains the color correction information of the plurality of color sub-pixels in the first color pixel.

9. The rendering apparatus according to claim 7, further comprising one or more memories configured to store the first image information and the m pieces of second image information.

10. The rendering apparatus according to claim 7, wherein the rendering apparatus is configured to implement image rendering of a first display area; the first display area includes M first color pixels and S transparent pixels; M and S are both integers greater than or equal to 1, and S is greater than or equal to m; and the one or more processors are configured to:

render a first color pixel by using the image rendering information of each first color pixel.

11. The rendering apparatus according to claim 10, wherein the rendering apparatus is further configured to implement image rendering of a second display area; the second display area includes N second color pixels; each second color pixel includes a common color sub-pixel that is a color sub-pixel shared by two adjacent second color pixels, and N is an integer greater than or equal to 2; and the one or more processors are further configured to:

receive image information of the second display area adjacent to the first display area;

obtain, according to the image information of the second display area, N pieces of third image information corresponding to the N second color pixels;

obtain, according to the N pieces of third image information, image rendering information of the N second color pixels, so that image rendering information of each second color pixel contains grayscale information of a plurality of color sub-pixels in the second color pixel; and render the second display area by using the image rendering information of the N second color pixels.

12. The rendering apparatus according to claim 11, wherein the one or more processors are further configured to:

obtain, according to the N pieces of third image information, N groups of third pixel information corresponding to the N second color pixels, each group of third pixel information containing a plurality of pieces of third pixel information corresponding to the plurality of color sub-pixels in a corresponding second color pixel; and obtain, according to grayscale information of third pixel information corresponding to a common color sub-pixel in two adjacent second color pixels, grayscale information of the common color sub-pixel in one of the two adjacent second color pixels, wherein grayscale information of a common color sub-pixel included in a t-th second color pixel and shared with a (t−1)-th second color pixel is:

$$p_{(t,c)}^2 = \text{Gamma}\sqrt{\frac{p_{color(t,c1)}^{2\ Gamma} + p_{color(t-1,c2)}^{2\ Gamma}}{2}},$$

wherein $p_{color(t,c1)}^{\ 2}$ is a grayscale value contained in third pixel information corresponding to the common color sub-pixel and included in a t-th group of third pixel information; $p_{color(t-1,c2)}^{\ 2}$ is a grayscale value contained in third pixel information corresponding to the common color sub-pixel and included in a (t−1)-th group of third pixel information; c1 is a sequence number of the common color sub-pixel, shared by the t-th second color pixel and the (t−1)-th second color pixel, in the t-th second color pixel; c2 is a sequence number of the common color sub-pixel, shared by the t-th second color pixel and the (t−1)-th second color pixel, in the (t−1)-th second color pixel; t is an integer greater than or equal to 2 and less than or equal to N; and Gamma is a gamma value of the display.

13. The rendering apparatus according to claim 11, wherein in a case where image rendering information of each first color pixel contains grayscale information of a plurality of color sub-pixels in the first color pixel, and image rendering information of each second color pixel contains grayscale information of a plurality of color sub-pixels in the second color pixel, the one or more processors are further configured to:

obtain, according to grayscale information of color sub-pixels in M first color pixels and the grayscale information of color sub-pixels in N second color pixel, grayscale correction information of the color sub-pixels in the M first color pixels;

adjust the grayscale information of the color sub-pixels in the M first color pixels, so that along a direction toward the second display area, grayscale values of color sub-pixels in the first display area gradually approach grayscale values of color sub-pixels in the N second color pixels; and perform brightness uniformization on image rendering information of the M first color pixels and the image rendering information of the N second color pixels.

14. A display apparatus, comprising:

a display panel including a first color pixel and m transparent pixels adjacent to the first color pixel, and the rendering apparatus according to claim 7, the rendering apparatus being electrically connected to the display panel.

15. A non-transitory computer-readable storage medium storing one or more computer program instructions that, when executed by one or more processors, cause the one or more processors to perform one or more steps in the pixel rendering method according to claim 1.

16. A non-transitory computer-readable storage medium storing one or more computer program instructions that, when executed by one or more processors, cause the one or more processors to perform one or more steps in the image rendering method according to claim 3.

* * * * *